US009666976B1

(12) United States Patent
Chang et al.

(10) Patent No.: US 9,666,976 B1
(45) Date of Patent: May 30, 2017

(54) PORTABLE CABLE ASSEMBLY

(71) Applicant: Cheng Uei Precision Industry Co., Ltd., New Taipei (TW)

(72) Inventors: Gen-Yuan Chang, New Taipei (TW); Shuo-Yuan Jan, New Taipei (TW); Kun-Wei Tsai, New Taipei (TW); Shou-Fu Kuo, New Taipei (TW)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 15/172,138

(22) Filed: Jun. 2, 2016

(51) Int. Cl.
*H01R 13/52* (2006.01)
*H01R 13/62* (2006.01)

(52) U.S. Cl.
CPC ..... *H01R 13/5213* (2013.01); *H01R 13/6205* (2013.01)

(58) Field of Classification Search
CPC ..... H01R 13/6205; H01R 13/5213
USPC ..... 439/37, 501, 528
See application file for complete search history.

(56) References Cited

U.S. PATENT DOCUMENTS 5,004,425 A * 4/1991 Hee ..... A41D 13/008 361/220
5,468,159 A * 11/1995 Brodsky ..... H01B 7/0846 174/117 F
6,215,639 B1 * 4/2001 Hee ..... A61N 1/14 361/212
6,858,797 B2 * 2/2005 Sheikholeslami ..... F16G 13/16 174/480
6,984,782 B2 * 1/2006 Ikeda ..... H02G 11/006 174/21 JS
7,345,954 B2 * 3/2008 Ehrsam ..... A44C 5/18 368/10
D583,815 S * 12/2008 Giovannoni ..... D11/3
7,618,260 B2 * 11/2009 Daniel ..... A44C 5/0007 24/311
8,758,045 B2 * 6/2014 McSweyn ..... H01R 13/60 439/501
9,017,097 B2 * 4/2015 Chen ..... G06F 13/38 439/528
D759,019 S * 6/2016 Harper ..... D14/435.1
2009/0111286 A1 * 4/2009 Giovannoni ..... G06K 19/07762 439/37

* cited by examiner

*Primary Examiner* — Abdullah Riyami
*Assistant Examiner* — Nelson R Burgos-Guntin
(74) *Attorney, Agent, or Firm* — Cheng-Ju Chiang

(57) ABSTRACT

A portable cable assembly includes a first connection port, a second connection port, a cable, an absorptive element, a shell and a sleeve. The first connection port has a first base portion and a first mating portion, the first base portion defines a containing groove in an outer surface thereof. The second connection port has a second base portion and a second mating portion. Two ends of the cable are connected with the first base portion and the second base portion. the absorptive element is accommodated in the containing groove. The shell surrounds the first base portion and the absorptive element. The sleeve is capable of sliding to sleeve the first connection port and the second connection port therein, and the sleeve can be absorbed on the shell by the absorptive element.

4 Claims, 4 Drawing Sheets

PORTABLE CABLE ASSEMBLY

BACKGROUND OF THE INVENTION

1. Field of the Invention

The present invention generally relates to a portable cable assembly, and more particularly to a portable cable assembly easy to be collected and carried.

2. The Related Art

With the popularity of the smart phone and other portable mobile electronic devices, a portable cable as a kind of electronic accessory for charging or transmitting the data has been widely applied in various of the portable electronic devices.

The portable cable is usually placed at home or office because the portable cable usually is a long and slender shape, which is not easy to be collected and carried. When the consumers are out, they need to put the portable cable into bags or pockets of their clothes. However, because the function of the portable cable is too simple and the portability of the portable cable is inconvenient, the phenomenon that the consumers forget to carry the portable cable often occurs in life. Therefore, the traditional portable cable can not meet the consumer demand for being easy to be carried and use anywhere, which brings to people's lives inconvenience.

SUMMARY OF THE INVENTION

An object of the present invention is to provide a portable cable assembly which is easy to be collected. The portable cable assembly includes a first connection port, a second connection port, a cable, an absorptive element, a shell and a sleeve. The first connection port has a first base portion and a first mating portion, the first base portion defines a containing groove in an outer surface thereof. The second connection port has a second base portion and a second mating portion. Two ends of the cable are respectively connected with the first base port and the second base port. The absorptive element is mounted inside the containing groove. The shell surrounds the first base portion and the absorptive element. The sleeve sleeves the first connection port, the second connection port and the shell therein. An end of the sleeve is absorbed on the shell by the absorptive element when the sleeve sleeves the first connection port, the second connection port and the shell therein.

As mentioned above, the sleeve is capable of sliding and sleeving the first connection port and the second connection port and being absorbed on the shell by the absorptive element. The sleeve can protect the first connection port and the second connection port from damage when the portable cable assembly is unused, and further accomplish the collection function. Therefore, the portable cable assembly is easy to be carried.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
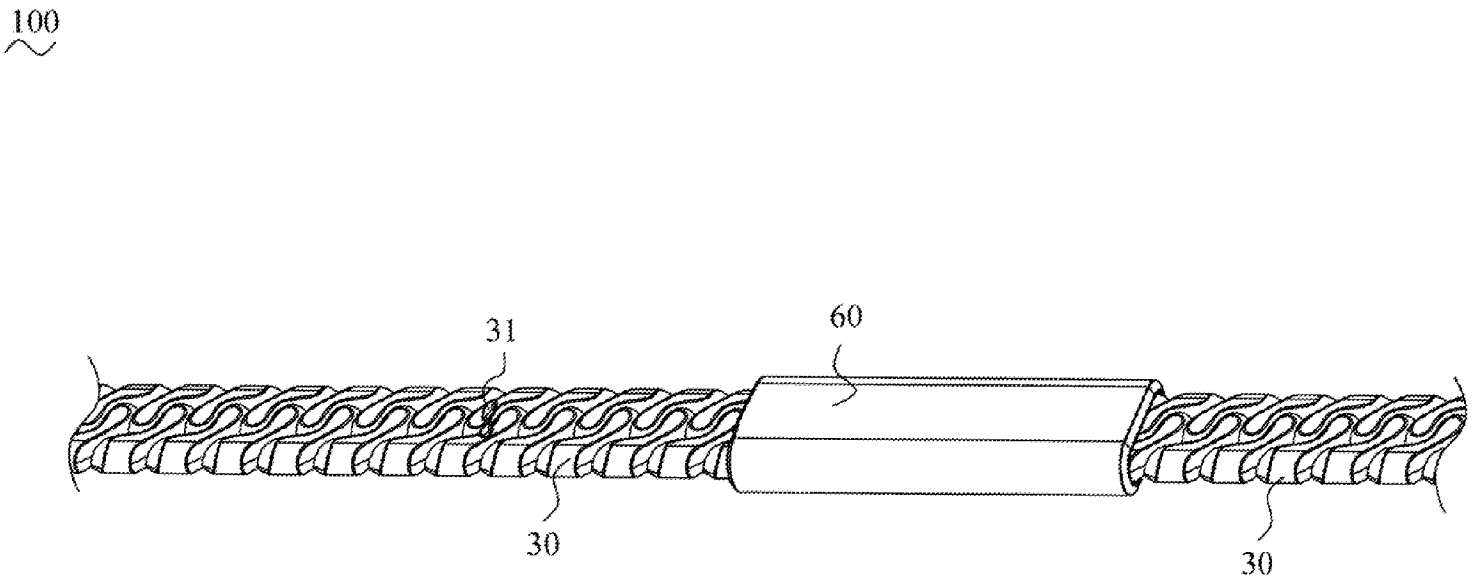
FIG. 1 is a perspective view of a portable cable assembly in accordance with an embodiment of the present invention.

With reference to FIGS. 1-4, a portable cable assembly 100 in accordance with an embodiment of the present invention is shown. The portable cable assembly 100 includes a first connection port 10, a second connection port 20, a cable 30, an absorptive element 40, a shell 50 and a sleeve 60.

The first connection port 10 includes a first base portion 11 and a first mating portion 12. The first base portion 11 defines a containing groove 111 in an outer surface thereof. The inside of the containing groove 111 has a capacity space to accommodate the absorptive element 40. The second connection port 20 includes a second base portion 21 and a second mating portion 22. In this embodiment, the first connection port 10 can be a lightning connector, and the second connection port 20 can be a USB port, but the first connection port 10 and the second connection port 20 can be other kinds of connectors in other embodiments.

Two ends of the cable 30 are connected with the first base portion 11 and the second base portion 21, respectively. An outer appearance of the cable 30 can be designed to various shapes for ease of carrying, such like as the necklace. The cable 30 includes a raised stop portion 31 at a position spaced from the second base portion 21. A cross section of the cable 30 is smaller than a cross section of the second base portion 21.

The absorptive element 40 is accommodated in the containing groove 111, in this embodiment, the absorptive element 40 is a magnet.

Figure 2:
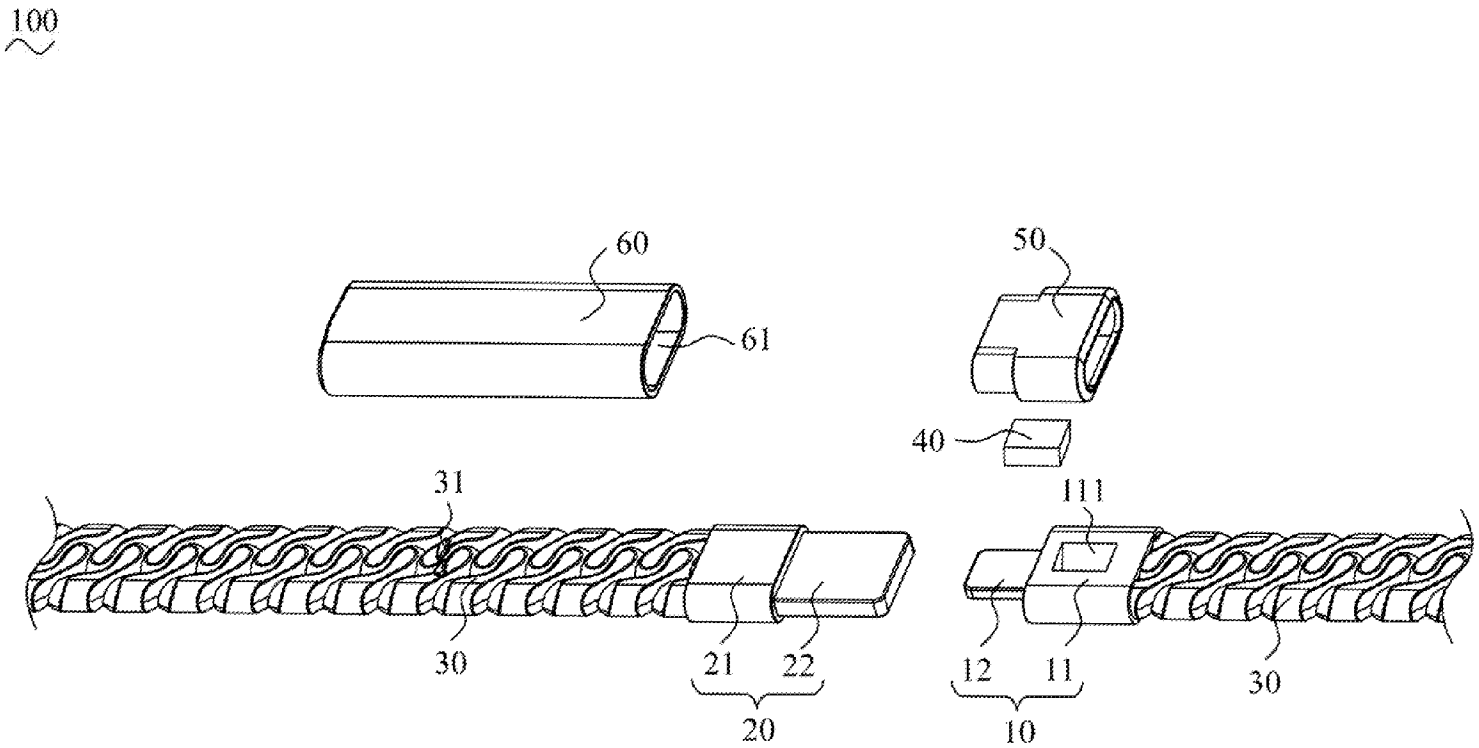
FIG. 2 is an exploded view of the portable cable assembly of FIG. 1.
Figure 4:
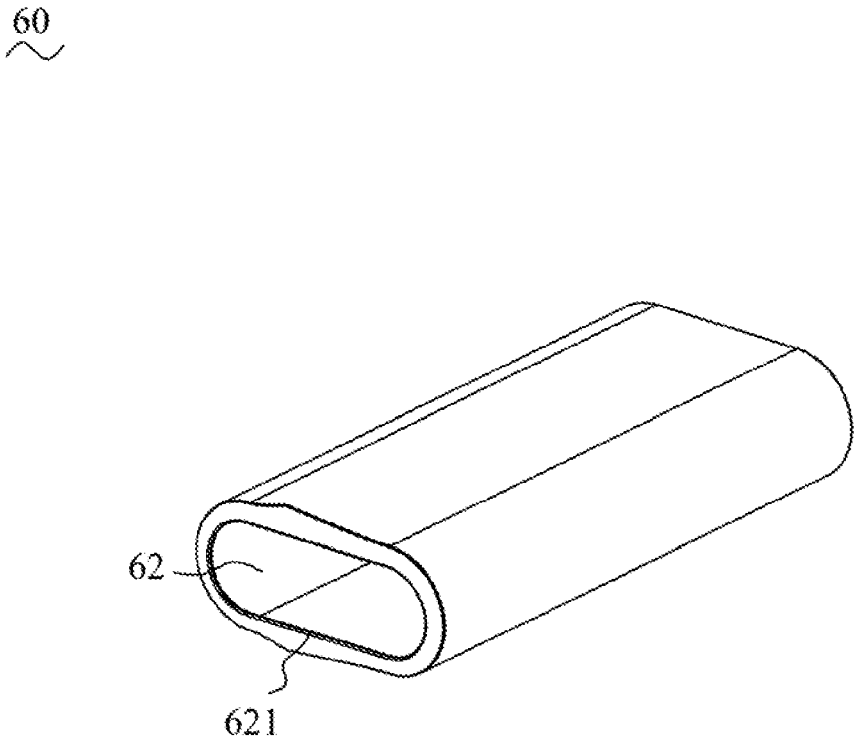
FIG. 4 is a perspective view of the sleeve of the portable cable assembly of FIG. 3.

Referring to FIG. 2 and FIG. 4, the shell 50 fixedly encircles a periphery of the first base portion 11 and the absorptive element 40. A cross section of the shell 50 is smaller than a cross section of the sleeve 60 in order to make the sleeve 60 can sleeve the shell 50.

The sleeve 60 has an appropriate length for sleeving the first connection port 10, the second connection port 20 and the shell 50 therein, the sleeve 60 can be configured to have different length as long as meeting the length from the first base port 11 to the second base port 21. The sleeve 60 has two opposite ends, one end facing the second base port 21 is defined as an insert end 61 and the other end facing the cable 30 is defined as a stop end 62. A periphery of the stop end 62 of the sleeve 60 protrudes inward to form a protruding portion 621, the protruding portion 621 is used for preventing the sleeve 60 from escaping the specific range of the movement.

Figure 3:
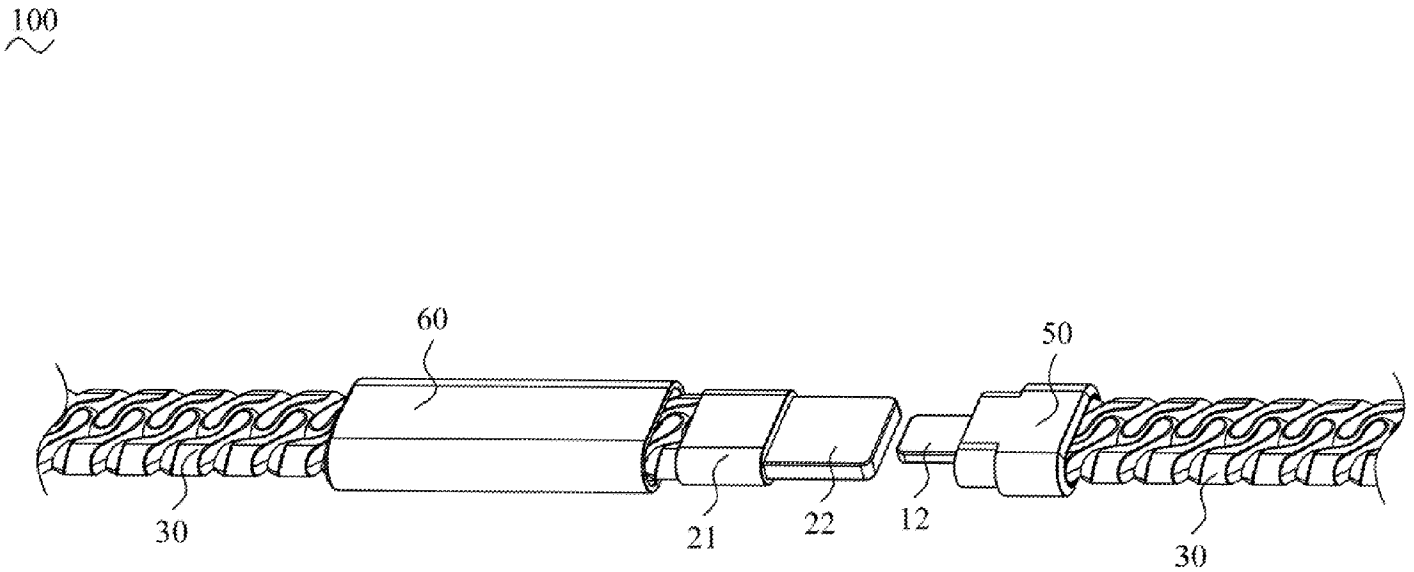
FIG. 3 is another perspective view of the portable cable assembly of FIG. 1, wherein a sleeve of the portable cable assembly sleeves a cable of the portable cable assembly.

Please referring to FIG. 1 to FIG. 3, the sleeve 60 is capable of sliding toward the second connection port 20, the stop end 62 of the sleeve 60 moves from the raised stop portion 31 of the cable 30 until the protruding portion 621 of the sleeve 60 is blocked by an end of the second base port 21 which connected with the end of the cable 30, in the same time, the insert end 61 of the sleeve 60 moves until the insert end 61 of the sleeve 60 passes through the second connection port 20. While the sleeve 60 slides to predetermined position, the first connection port 10 plugs in the sleeve 60 and the sleeve 60 is absorbed on the shell 50 by the absorptive element 40.

In this embodiment, the absorptive element 40 is a magnet and the sleeve 60 is magnetic material, consequently, the sleeve 60 can be magnetized by the absorptive element 40.

The shell 50 also can be a magnetic material in this embodiment or other kinds of material in other embodiments.

As above mentioned, the sleeve 60 is capable of sliding and sleeving the first connection port 10 and the second connection port 20 and being absorbed on the shell 50 by the absorptive element 40. The sleeve 60 can protect the first connection port 10 and the second connection port 20 from damage when the portable cable assembly 100 is unused, and further accomplish the collection function, in the same time, the portable cable assembly 100 also can server as the accessory for easy carrying such like the necklace to endue with the fashion function.

What is claimed is:

1. A portable cable assembly, comprising:

a first connection port, the first connection port having a first base portion and a first mating portion, the first base portion defining a containing groove in an outer surface thereof;

a second connection port, the second connection port having a second base portion and a second mating portion;

a cable, two ends of the cable being connected with the first base portion and the second base portion;

an absorptive element, the absorptive element being accommodated in the containing groove;

a shell, the shell surrounding the first base portion and the absorptive element; and a sleeve for sleeving the first connection port, the second connection port and the shell therein, an end of the sleeve being absorbed on the shell by the absorptive element when the sleeve sleeves the first connection port, the second connection port and the shell therein.

2. The portable cable assembly as claimed in claim 1, wherein a periphery of an opposite end of the sleeve protrudes inward to form a protruding portion, the cable has a raised stop portion at a position spaced from the second base portion, a cross section of the cable is smaller than a cross section of the second base portion, the sleeve is capable of sliding towards the raised stop portion of the cable to expose the second connection port until the protruding portion of the sleeve is blocked by the raised stop portion of the cable, the sleeve is capable of sliding away from the raised stop portion of the cable to sleeve the second connection port until the protruding portion of the sleeve is blocked by an end surface of the second base portion adjacent to the cable.

3. The portable cable assembly as claimed in claim 1, wherein the absorptive element is a magnet and the sleeve is magnetic material.

4. The portable cable assembly as claimed in claim 1, wherein the first connection port is a lightning connector, the second connection port is a universal serial bus (USB) plug connector.

* * * * *